US008042612B2

(12) United States Patent
Crossley et al.

(10) Patent No.: US 8,042,612 B2
(45) Date of Patent: Oct. 25, 2011

(54) METHOD AND DEVICE FOR MAINTAINING SUB-COOLED FLUID TO ESP SYSTEM

(75) Inventors: Alexander Crossley, Broken Arrow, OK (US); John L. Bearden, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 12/484,889

(22) Filed: Jun. 15, 2009

(65) Prior Publication Data

US 2010/0314103 A1 Dec. 16, 2010

(51) Int. Cl.
*E21B 47/00* (2006.01)

(52) U.S. Cl. ..... 166/252.1; 166/369; 166/250.15; 417/18; 417/32; 417/44.2

(58) Field of Classification Search ..... 166/250.01, 166/250.15, 252.1, 369; 417/18, 32, 44.2, 417/53; 700/282
See application file for complete search history.

(56) References Cited

U.S. PATENT DOCUMENTS

| | | | | |
|---|---|---|---|---|
| 3,276,383 | A | 10/1966 | Eisele | |
| 4,278,051 | A | 7/1981 | Shida | |
| 4,650,633 | A * | 3/1987 | Youngborg | 376/210 |
| 4,718,824 | A * | 1/1988 | Cholet et al. | 417/14 |
| 4,913,625 | A | 4/1990 | Gerlowski | |
| 5,124,115 | A | 6/1992 | Dillmann | |
| 5,435,148 | A | 7/1995 | Sandofsky | |
| 5,558,502 | A | 9/1996 | Fukazawa | |
| 6,167,965 | B1 * | 1/2001 | Bearden et al. | 166/250.15 |
| 6,375,422 | B1 | 4/2002 | Bingham | |
| 6,454,010 | B1 | 9/2002 | Thomas | |
| 6,663,349 | B1 | 12/2003 | Discenzo | |
| 7,086,486 | B2 | 8/2006 | Ravensbergen | |

* cited by examiner

*Primary Examiner* — William P Neuder
*Assistant Examiner* — Richard Alker
(74) *Attorney, Agent, or Firm* — Bracewell & Giuliani LLP

(57) ABSTRACT

A method of operating an electrical submersible pumping system that includes realtime monitoring of the wellbore fluid and adjusting pump speed so the fluid entering the pump remains subcooled. The method can include adding sensors within the wellbore and digitally storing fluid data accessible by a pump controller. The pump speed can be increased or decreased by adjusting the frequency of the electrical power delivered to the pump motor.

13 Claims, 4 Drawing Sheets

METHOD AND DEVICE FOR MAINTAINING SUB-COOLED FLUID TO ESP SYSTEM

FIELD OF THE INVENTION

The present disclosure relates in general to monitoring fluid to an electrical submersible pump (ESP) assembly and controlling ESP assembly operation so its inlet fluid remains subcooled.

DESCRIPTION OF PRIOR ART

Submersible pumping systems are often used in hydrocarbon producing wells for pumping fluids from within the well bore to the surface. These fluids are generally liquids and include produced liquid hydrocarbon as well as water. One type of system used in this application employs an electrical submersible pump (ESP). Submersible pumping systems, such as electrical submersible pumps (ESP) are often used in hydrocarbon producing wells for pumping fluids from within the well bore to the surface.

Electrical submersible pump (ESP) assemblies are often used in hydrocarbon producing wells for enabling or improving the flow of fluids from within the well bore to the surface. A typical ESP assembly includes a centrifugal pump driven by a three-phase AC motor, both located in the well bore. A surface mounted variable speed drive (VSD) and associated output transformer are generally used to deliver electrical power to an ESP; a cable connects the output transformer to the pump motor.

In some hydrocarbon producing fields, the crude is too viscous to freely flow and requires heating allowing it to flow from the formation into the producing wellbore. Steam injection, such as Steam Assisted Gravity Drainage (SAGD) can heat the crude past its pour point to enable free flow. Steam injected into a hydrocarbon producing formation typically condenses and flows as hot water condensate with the produced fluid through the ESP. The hot water condensate is generally close to its saturation point and thus prone to flashing back into a vapor state. Thus care must be taken when pumping produced fluid having hot water condensate to prevent pump cavitation by vaporization of the condensate.

DETAILED DESCRIPTION OF THE INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
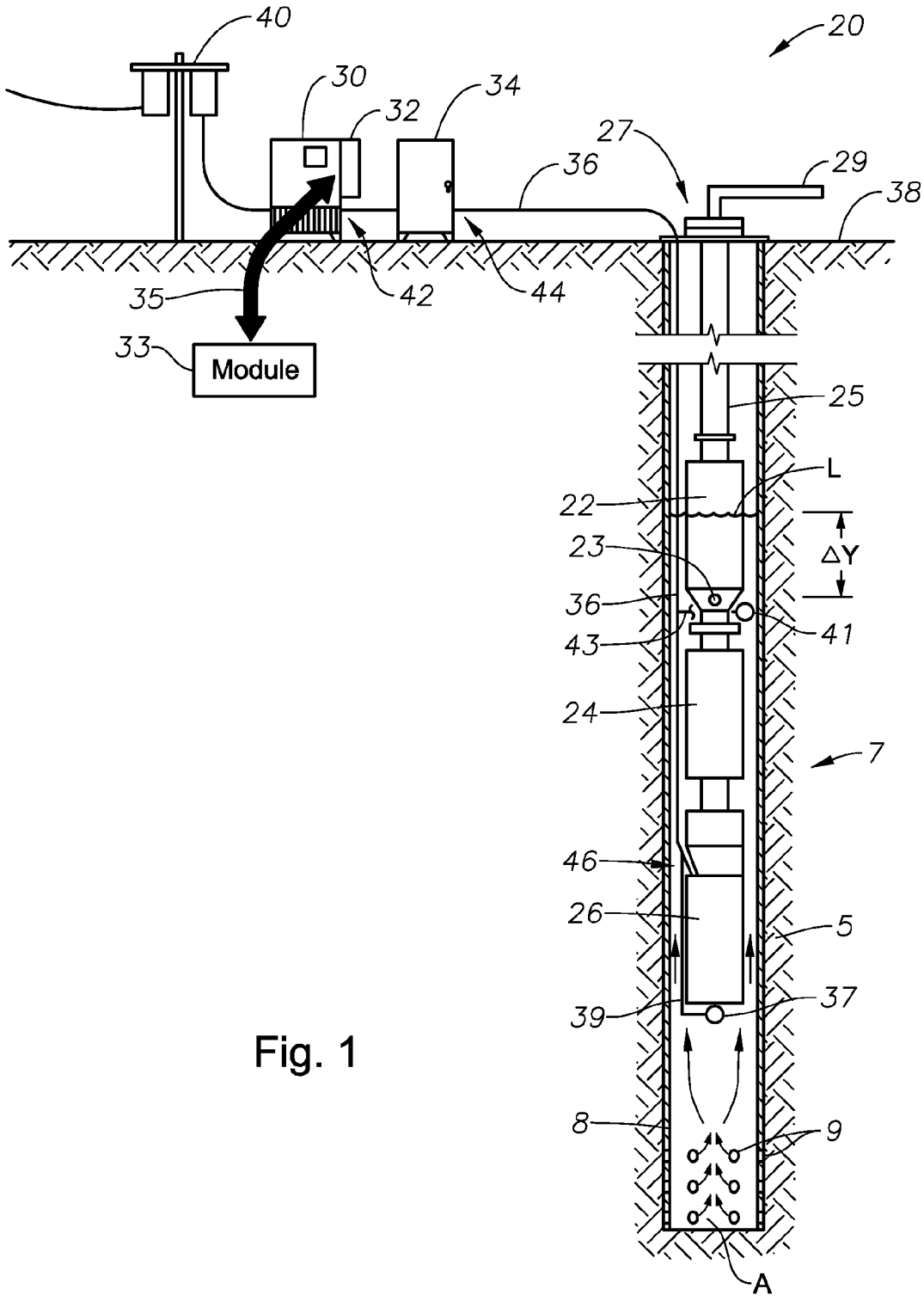
FIG. 1 is a schematic partial sectional side view of an embodiment of an ESP assembly in accordance with the present disclosure.

With reference now to FIG. 1, an example of an electrical submersible pump assembly 20 is depicted for producing fluids from a wellbore 7. The assembly 20 includes a centrifugal pump 22, a pump motor 26, and a seal assembly 24 located between the pump 22 and motor 26. The pump motor 26 can be a three-phase electrical motor. Lining the wellbore 7 is a string of casing 8 cemented to a surrounding formation 5. Fluid flows from the formation 5 into the wellbore 7 through perforations 9 in the casing 8. The fluid, represented by arrows A, flows past the pump motor 26 and seal 24 to the pump 22. The fluid enters the pump 22 through a pump inlet 23 provided on the pump 22 housing. The fluid, after being pressurized, is discharged from the pump 22 into production tubing 25 for conveying the fluid to a wellhead assembly 27. A production line 29 connected to the wellhead assembly 27 carries the produced fluid to storage or a transmission line so it can be delivered for refining. Optionally, the perforations 9 can be above the pump inlet 23.

The ESP assembly 20 further includes a variable speed drive 30, a controller 32, and an output transformer 34, all located on the surface 38. A module 33 is shown coupled to the controller 32 via a data link 35. The module 33 can be internal to the controller 32, adjacently located, or remotely located. The module 33 may be an information handling system (IHS), such as a processor, or memory, and the data link 35 can be a member for conveying a signal, such as a wire or optical fiber. Optionally, the data link 35 can be a wireless communication, such as telemetry. As will be described in more detail below, the module 33 can include information and/or process steps. Sensors 37, 41 shown disposed within the wellbore 7 are provided with the ESP system 20. Sensor 37 is shown proximate the motor 26 having a lead 39 connected to the cable 36. A signal from the sensor 37 can be transmitted uphole via a cable 36. Sensor 41 is shown proximate the pump inlet 23 having an associated lead 43 also connected to the cable 36. The sensors 37, 41 can be used to measure wellbore 7 conditions such as temperature and/or pressure.

The cable 36 provides power and communications between the output transformer 34 at the surface and the downhole pump motor 26. An external power source (not shown), such as, for example, a power plant, provides electricity to a variable speed drive 30, often through one or more transformers 40. The variable speed drive 30 then operates as a power source for providing electrical power for driving the motor 26, through an output transformer 34 and cable 36. By altering the output voltage and frequency of the variable speed drive 30, the controller 32 associated with the variable speed drive 30 controls the voltage at motor 26 terminals. The power system of typical ESP system can be divided into three main sections: the primary side, surface, as shown at 42; the secondary side, surface, as shown at 44; and the secondary side, downhole, as shown at 46. Those skilled in the art will recognize that the nature of electricity is such that numerous points are equivalent to the locations indicated, including, for example, locations within the variable speed drive 30, locations inside the output transformer 34, and inside the pump motor 26.

As noted above, the bottom hole flowing pressure of the produced hot water must exceed its saturation pressure to prevent flashing to vapor. As is known, formation fluid includes multiple components, some of which can vaporize if the bottom hole flowing pressure drops too low. The fluid components can be identified through fluid analysis of produced fluid from the same or an adjacent wellbore. In addition to hydrocarbons drawn from the formation, the produced fluid can include water. The water may be resident within the formation or added to boost production. For example, fluid production in some wells may be enhanced by injecting steam into the formation 5. Although the steam may condense within the fluid, it can become mixed with the produced fluid and pose a vapor or free gas threat to the pump performance. To prevent the formation of vapor or gas from the produced fluid, the pump 22 flow rate can be controlled so that the flowing bottom hole pressure in the wellbore 7 is maintained above the saturation pressure for the fluid. Yet further optionally, fluid pressure and temperature can be monitored and liquid properties consulted to estimate if a liquid or one of its constituent is close to boiling. Although the saturation pressure is dependent on many variables, it can be determined by those skilled in the art.

Information about a produced fluid can be stored on the module 33 for retrieval by the controller 32 or a processor associated with the module 33. The fluid information may provide a state or condition of the produced fluid constituent, and can be in the form of data or an algorithm. In one example, the fluid information includes a fluid's saturation pressure or boiling point in terms of associated temperature and pressure. Optionally, the fluid to be pumped is evaluated, and the wellbore 7 temperature and pressure are measured by sensor 37, 41. The evaluation can include identifying each constituent in the fluid. Knowledge of fluid constituents and their operating conditions in the wellbore 7, provides the ability to evaluate the fluid's potential for vaporization. If potential vaporization conditions are present, the ESP assembly 20 operation can be adjusted accordingly. In an example, pressure at the pump inlet 23 is increased by raising the liquid column level ΔY. Wellbore 7 fluid level can be adjusted with pump 22 speed; for example, altering pump 22 flowrate to above or below the fluid flowrate into the wellbore 7 from the formation 5 will respectively raise or lower the liquid level L. Thus reducing pump 22 speed increases pump inlet 23 pressure. Pump 22 speed is controllable by adjusting one or more of voltage, current, or frequency delivered to the motor 26 from the variable speed drive 30. In another method, a throttling valve at the surface wellhead can be adjusted to control the flow from the well, which also raises or lowers the bottom hole flowing pressure.

In another embodiment, the controller 32 cooperates with the module 33 to evaluate the fluid, where the module 33 includes fluid data and/or an algorithm to model the fluid. In this example, temperature and pressure values can be obtained from one or both of the sensors 37, 41. The module 33 can also include saturation pressure values as well as steps or instructions to estimate a minimum value for ΔY, the values or instructions for determining the values can be communicated to the controller 32 via the communication link 35.

Figure 2:
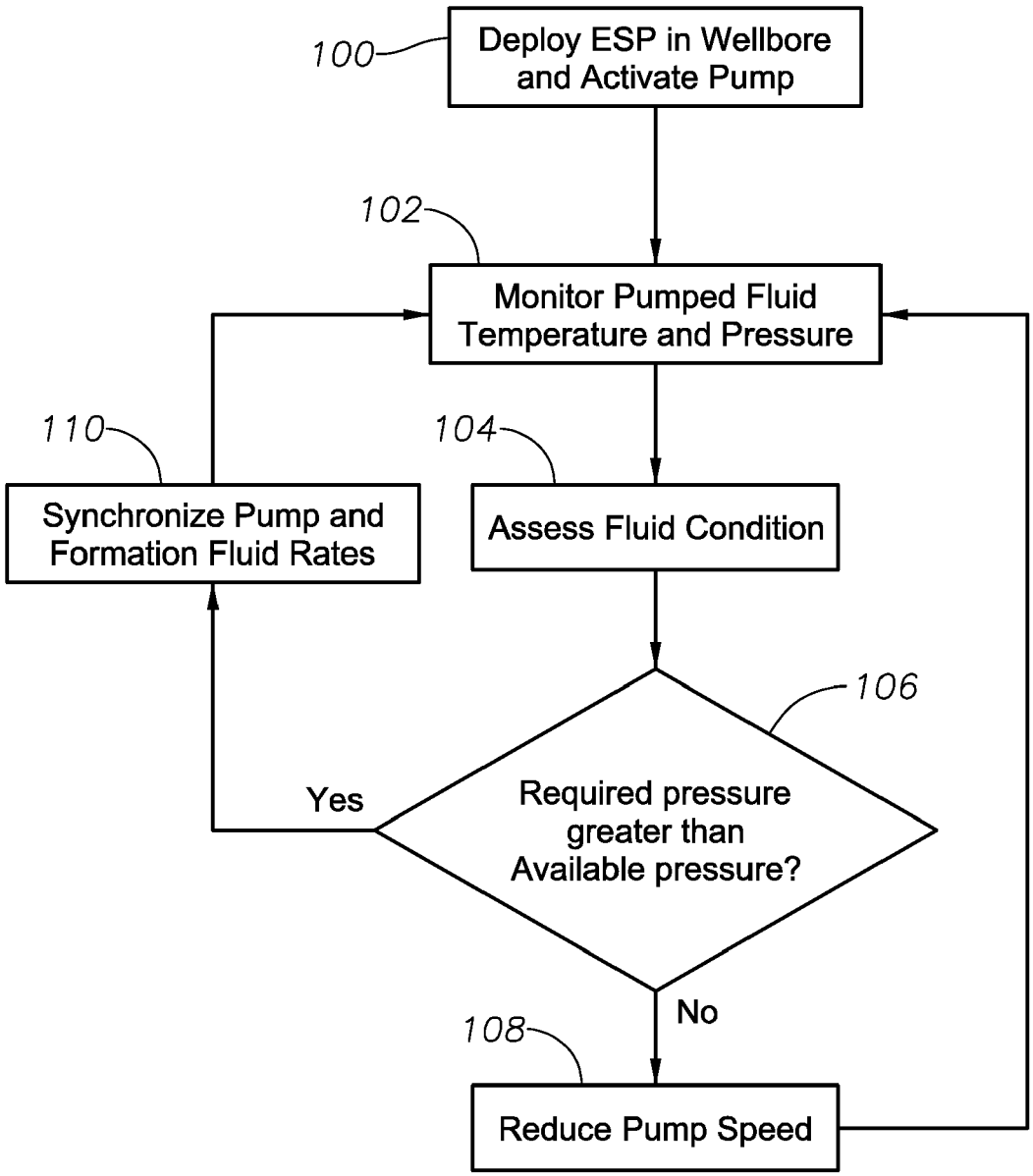
FIG. 2 is a flowchart illustrating an example of operating an ESP as disclosed herein.

An example of a method for operating an ESP assembly 20 is shown in a flowchart as provided in FIG. 2. In the example shown, an ESP assembly is deployed in the wellbore 7 and the pump motor 24 activated (step 100) so the pump 22 will begin pumping fluid from the wellbore 7. The wellbore 7 fluid temperature and pressure are monitored in step 102; which can be done by the sensors 37, 41 (FIG. 1). This may include monitoring fluid level as well. Knowing the fluid temperature and pressure, the fluid condition can be determined (step 104) and the determination can involve consulting fluid data: Fluid data can be a table, chart, graph directed to each constituent in the fluid. Fluid condition can include the fluid's state and proximity to boiling point indicating the fluid's available pressure margin above where it begins to cavitate within a pump. Optionally, only some of the wellbore fluid constituents would be evaluated, such as those more likely to vaporize during pumping operations. Examples can be water and certain light end hydrocarbons. The data can be from known established tables or from tests from a particular wellbore 7.

Results of the fluid assessment in step 104 yields the pressure drop available in the fluid before vaporization may occur. With this information, the wellbore can be produced at a maximum (optimum) rate by maintaining this pressure drop at a minimum, safe value. If the required pressure exceeds the available pressure (step 106) the pump operation can be adjusted by slowing the pump 22 (step 108). This can avoid fluid vaporization in the pump 22 or in the wellbore before the pump intake. The lower pump 22 speed translates into a lower fluid flow rate into the pump 22 that in turn increases the fluid pressure at and into the pump intake. Moreover, as noted above, the reduced pump 22 flow rate lengthens the fluid column ΔY above the pump inlet 23 to increase pressure at the pump inlet 23. The method can continue to loop through the steps 102-108 until the available pressure exceeds the required pressure at the pump inlet 23.

When the available pressure sufficiently exceeds the required pressure, pump 22 operation can remain unaltered and the method continues with a re-evaluation of wellbore 7 fluid conditions in step 102. A value of sufficiently exceeding the required pressure can include the available pressure exceeding the required pressure by a safety factor. In an example, the added safety factor can range from about 1-5 pounds per square inch (psi). Optionally, pump 22 performance can be increased by synchronizing pump 22 flowrate with formation fluid flowrate into the wellbore 7 (step 110). Equalizing flowrates into and out of the wellbore 7 stabilizes the static head on the pump 22 and allows the pump 22 operation to be at substantially the same speed/flowrate; that in turn increases pump 22 performance by minimizing pump 22 load variations. Flowrate equalization can be achieved by monitoring pressure at the pump inlet 23 over time and iteratively adjusting the pump 22 flowrate in response to variations in measured pressure until the pressure remains substantially constant.

Figure 3:
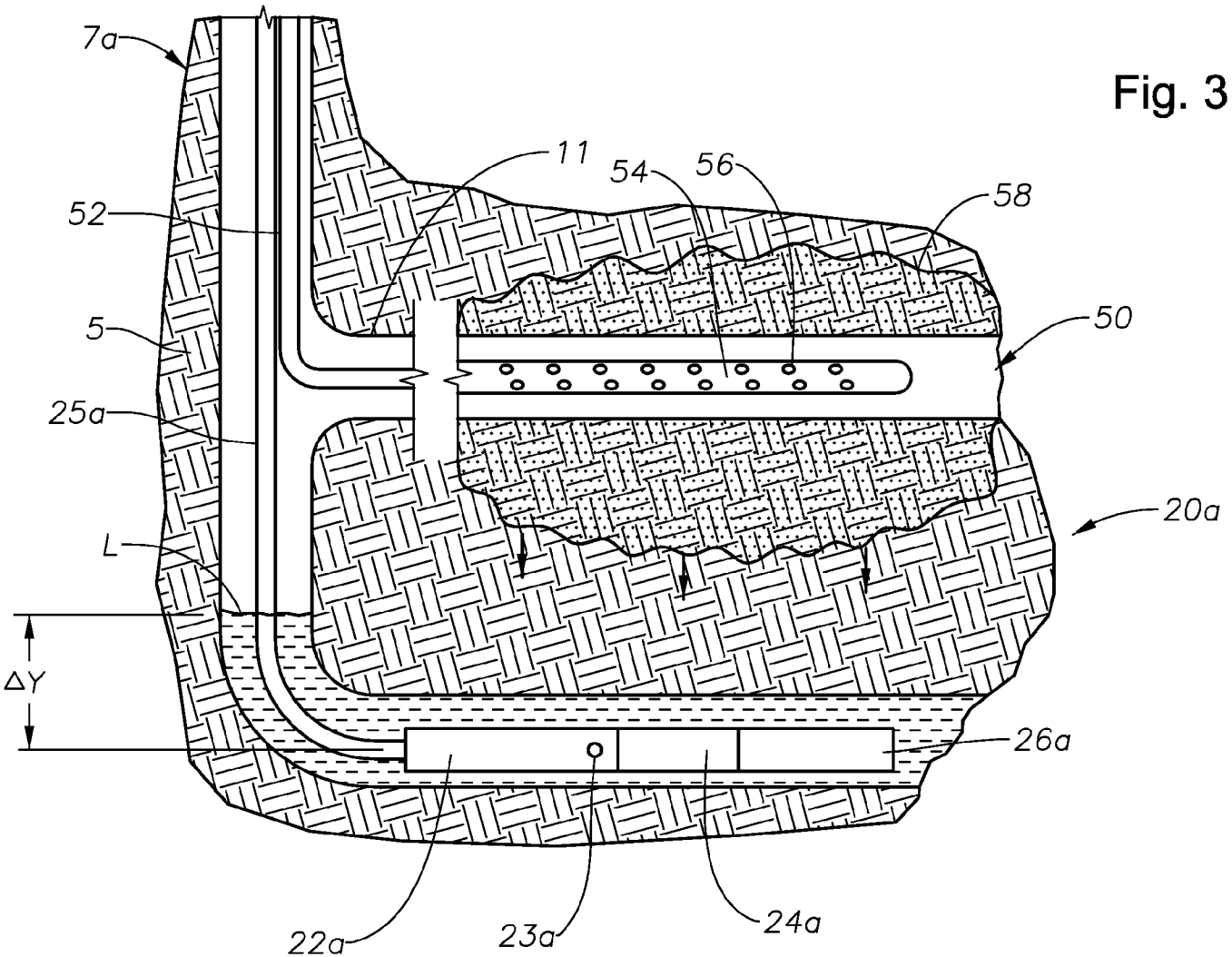
FIG. 3 is a schematic partial sectional view of an ESP assembly in a steam assisted gravity drain application.

An alternative example of an electrical submersible pumping system assembly **20*a* is illustrated in side partial sectional view in FIG. 3. The assembly 20*a* is shown deployed in the horizontal portion of a deviated wellbore 7*a* having a lateral bore 11 above the horizontal. A steam assist system 50 in the wellbore 7*a* includes a steam supply line 52 that delivers heating steam from the surface to a discharge header 54. The steam discharges from the header 54 through perforations 56 and migrates into the formation 5 surrounding the lateral 11. The steam creates a heated zone 58 around the lateral 11 that heats heavy end hydrocarbons trapped in the formation 5. The heat lowers the hydrocarbons viscosity so they can flow from the formation 5 down into the horizontal portion of the wellbore 7*a*. Similar to the assembly 20 of FIG. 1, fluid enters a pump inlet 23*a* and pressurized by a pump 22*a*. The pump 22*a* is driven by a pump motor 26*a*. A seal 24*a* is shown provided between the pump 22*a* and pump motor 26*a*. The pressurized fluid discharges from the pump 22*a* into a production line 25*a* shown angled from the main vertical portion of the wellbore 7*a*** into the horizontal portion.

A liquid level L can be maintained in the vertical portion of the wellbore **7*a* so that pump inlet pressure is sufficiently above fluid saturation pressure or boiling point. As with the assembly 20 of FIG. 1, the temperature and pressure within the wellbore 7*a* can be monitored to detect a potential flashing condition. Moreover, the steam flowrate or steam conditions can be adjusted so that pump inlet 23*a*** conditions are safely below the fluid boiling point.

Figure 4:
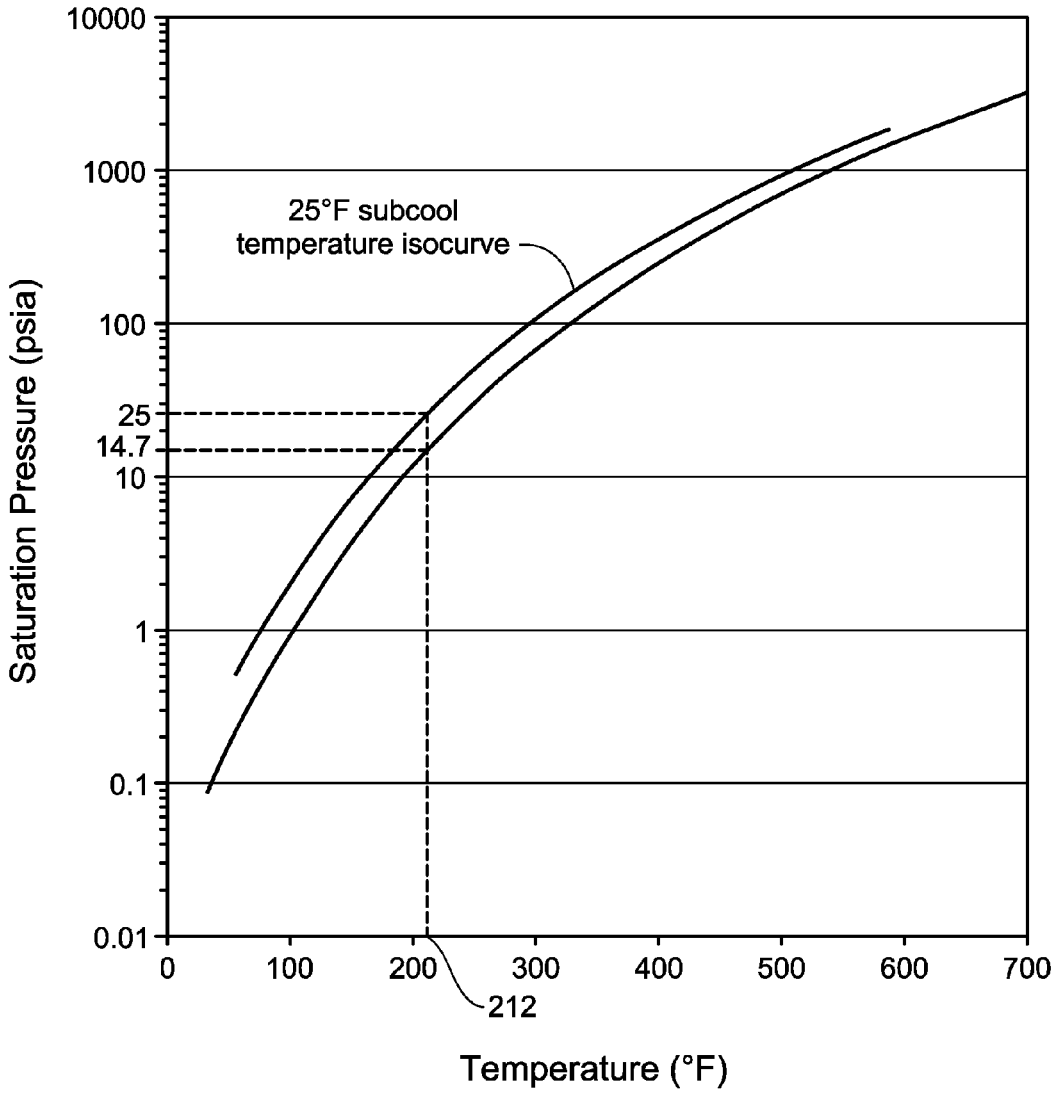
FIG. 4 is a logarithmic chart with a curve representing water vapor pressure values over a temperature range.

FIG. 4 includes a chart of saturation or vapor pressure of water over a temperature range. Also included in the chart is a "subcooled" curve generated by moving the vapor pressure curve towards the origin along the abscissa by a subcooled margin. Pressure with respect to temperature, referred to herein as a "subcooled pressure" is greater on the subcooled curve than on the vapor pressure curve. Thus the fluid will be subcooled when at a temperature and pressure that intersects at the subcooled curve. For example, as shown in FIG. 4, at 212° F. water vapor pressure is at 14.7 psia, whereas the subcooled pressure is about 25 psia. In an alternative embodiment, an ESP system 20, 20*a* is operated by measuring temperature in the fluid to be pumped, identifying the corresponding "subcooled" pressure from the subcooled chart, and adjusting the pump 22, 22*a* speed so that the pressure at the pump inlet 23, 23*a* is at least at great as the subcooled pressure. When operating an ESP system 20, 20*a* so the pump 22, 22*a* inlet pressure is at a set value above the fluid vapor pressure, the pump 22, 22*a* speed does not need constant adjustment due to some operating transients i.e. occasional pressure drops and/or temperature spikes. Maintaining a relatively constant pump 22, 22*a* speed maximizes pump 22, 22*a* efficiency by pumping over time at conditions closer to maximum flow. Moreover, the data from the subcooled curve can be stored in memory, such as a controller or processor, and accessed to operate an ESP system 20, 20*a* at or near its maximum efficiency. Other margin values include 5° F., 10° F., 15° F., 20° F., 30° F., 35° F., 40° F., 50° F., and temperature values between. Further embodiments exist where a margin value may be time dependent or change over time depending on well and/or well fluid conditions.

While the invention has been shown or described in only some of its forms, it should be apparent to those skilled in the art that it is not so limited, but is susceptible to various changes without departing from the scope of the invention. For example, various components and/or designs can be utilized to implement the algorithms described herein or a variation of these algorithms. The IHS may also be used to store recorded data as well as processing the data into a readable format. The IHS may be disposed at the surface, in the wellbore, or partially above and below the surface. The IHS may include a processor, memory accessible by the processor, nonvolatile storage area accessible by the processor, and logics for performing each of the steps above described. As such, those skilled in the art will appreciate that the operation and design of the present invention is not limited to this disclosure nor a specific embodiment discussed herein, but is susceptible to various changes without departing from the spirit and scope of the invention. In the drawings and specification, there have been disclosed illustrative embodiments of the invention and, although specific terms are employed, they are used in a generic and descriptive sense only and not for the purpose of limitation.

What is claim is:

1. A method of producing wellbore fluid comprising:

a) pumping wellbore fluid with an electrical submersible pump (ESP) assembly;

b) measuring fluid temperature and pressure before it enters the ESP assembly;

c) adding a subcooled margin to the measured fluid temperature to obtain a subcooled margin fluid temperature and identifying the fluid vapor pressure at the subcooled margin fluid temperature to define a subcooled fluid pressure; and d) controlling the pump so that the fluid pressure entering the ESP assembly is at least as great as the subcooled fluid pressure.

2. The method of claim 1, further comprising slowing the pump speed if the measured pressure is less than the subcooled fluid pressure.

3. The method of claim 1, wherein the subcooled margin comprises a value selected from a list consisting of 5° F., 10° F., 15° F., 20° F., 25° F., 30° F., 35° F., 40° F., 50° F., and temperature values between.

4. The method of claim 1, further comprising referencing a fluid information source for the fluid vapor pressure, wherein the fluid information source is selected from a list consisting of a table, a steam table, a chart, and an algorithm.

5. The method of claim 1, further comprising measuring wellbore fluid data realtime with a sensor.

6. The method of claim 1, further comprising maintaining pump speed if the measured pressure is at least as great as the subcooled fluid pressure.

7. The method of claim 1, further comprising automating steps (c) and (d) with an information handling system.

8. The method of claim 7, further comprising storing fluid data in a readable medium.

9. The method of claim 1, wherein the fluid comprises a liquid selected from the list consisting of formation fluid, water, and combinations thereof.

10. The method of claim 1, further comprising injecting steam into a formation adjacent the wellbore.

11. A method of producing fluid from a wellbore comprising:

providing a submersible pump in the wellbore;

pumping fluid with the pump;

measuring fluid pressure and temperature flowing to the pump;

defining a fluid subcooled pressure to be the fluid vapor pressure at a temperature exceeding the measured temperature by a subcooled margin value;

comparing the measured pressure and the subcooled pressure;

injecting steam into a formation adjacent the wellbore; and lowering the pump speed if the subcooled pressure exceeds the measured pressure.

12. The method of claim 11, further comprising analyzing wellbore fluid produced from the wellbore data to determine the fluid vapor pressure.

13. The method of claim 11, further comprising retrieving the fluid vapor pressure from data storage.

* * * * *